US010724172B2

(12) United States Patent
Yagi et al.

(10) Patent No.: US 10,724,172 B2
(45) Date of Patent: Jul. 28, 2020

(54) DISCHARGE PRINTING DEVICE AND DISCHARGE PRINTING METHOD

(71) Applicant: BROTHER KOGYO KABUSHIKI KAISHA, Nagoya-shi, Aichi (JP)

(72) Inventors: Ryohei Yagi, Nagoya (JP); Goro Okada, Nagoya (JP)

(73) Assignee: BROTHER KOGYO KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/367,714

(22) Filed: Mar. 28, 2019

(65) Prior Publication Data

US 2019/0301087 A1 Oct. 3, 2019

(30) Foreign Application Priority Data

Mar. 30, 2018 (JP) ..... 2018-070155
Mar. 30, 2018 (JP) ..... 2018-070157

(51) Int. Cl.

| | |
|---|---|
| ***D06P 3/00*** | (2006.01) |
| ***D06P 5/15*** | (2006.01) |
| ***D06L 4/30*** | (2017.01) |
| ***D06P 5/20*** | (2006.01) |

(52) U.S. Cl.

CPC ..... *D06P 5/155* (2013.01); *D06L 4/30* (2017.01); *D06P 5/2077* (2013.01)

(58) Field of Classification Search

CPC ..... D06P 5/155; D06P 5/134; D06P 1/221; D06P 5/153; D06P 5/30; D06P 5/3077; D06L 4/30; D06B 21/00

See application file for complete search history.

(56) References Cited

U.S. PATENT DOCUMENTS

2014/0289974 A1* 10/2014 Okada ..... D06P 5/30 8/457
2015/0252520 A1 9/2015 Okada et al.

FOREIGN PATENT DOCUMENTS

JP 2007-224128 A 9/2007
JP 2009209493 A * 9/2009
JP 2015-187248 A 10/2015

OTHER PUBLICATIONS

English translation of the Patent No. JP 2009209493 A dated Sep. 2009.*

* cited by examiner

*Primary Examiner* — Eisa B Elhilo
(74) *Attorney, Agent, or Firm* — K&L Gates LLP

(57) ABSTRACT

A discharge printing device includes an application unit configured to apply a reducing agent to fabric and a contact heating unit configured to subject a reducing agent-applied area to contact heating and satisfies any of the conditions (a1)-(c1) and (d1)-(e1): the conditions (a1)-(c1): in the contact heating, a heating temperature is 100° C. or more, and a heating time is 60 seconds or more; the conditions (d1)-(e1): the contact heating unit subjects the reducing agent-applied area to contact heating to accelerate a reduction reaction and subjects, after the acceleration of the reduction reaction, the reducing agent-applied area to contact heating to accelerate an oxidation reaction, or the discharge printing device further comprises a non-contact heating unit, and the non-contact heating unit subjects, after the acceleration of the reduction reaction, the reducing agent-applied area to non-contact heating to accelerate an oxidation reaction.

12 Claims, 4 Drawing Sheets

DISCHARGE PRINTING DEVICE AND DISCHARGE PRINTING METHOD

CROSS-REFERENCE TO RELATED APPLICATION

This application claims priority from Japanese Patent Application Nos. 2018-070155 and 2018-070157 filed on Mar. 30, 2018. The entire subject matter of the Japanese Patent Applications is incorporated herein by reference.

BACKGROUND

A method for subjecting fabric to discharge printing by applying a reducing agent to fabric and thereafter subjecting the fabric to a heat treatment has been proposed.

SUMMARY

A discharge printing device includes: an application unit configured to apply a reducing agent to fabric; and a contact heating unit configured to subject a reducing agent-applied area to contact heating, and the discharge printing device satisfies any of the conditions (a1), (b1), (c1), (d1), and (e1): the condition (a1): in the contact heating, a heating temperature is 100° C. or more and less than 150° C., and a heating time is 60 seconds or more; the condition (b1): in the contact heating, a heating temperature is 150° C. or more and less than 170° C., and a heating time is 45 seconds or more; the condition (c1): in the contact heating, a heating temperature is 170° C. or more, and a heating time is 30 seconds or more; the condition (d1): the contact heating unit subjects the reducing agent-applied area to contact heating to accelerate a reduction reaction and subjects, after the acceleration of the reduction reaction, the reducing agent-applied area to contact heating to accelerate an oxidation reaction; and the condition (e1): the contact heating unit subjects the reducing agent-applied area to the contact heating to accelerate a reduction reaction, and the discharge printing device further includes a non-contact heating unit, and the non-contact heating unit subjects, after the acceleration of the reduction reaction, the reducing agent-applied area to non-contact heating to accelerate an oxidation reaction.

The discharge printing method includes: an application step of applying a reducing agent to fabric; and a heat treatment step of subjecting a reducing agent-applied area to contact heating, and the discharge printing method satisfies any of the following conditions (a3), (b3), (c3), and (d3): the condition (a3): in the heat treatment step, a heating temperature is 100° C. or more and less than 150° C., and a heating time is 60 seconds or more; the condition (b3): in the heat treatment step, a heating temperature is 150° C. or more and less than 170° C., and a heating time is 45 seconds or more; the condition (c3): in the heat treatment step, a heating temperature is 170° C. or more, and a heating time is 30 seconds or more; and the condition (d3): the heat treatment step includes a reduction acceleration heat treatment step of subjecting a reducing agent-applied area to contact heating to accelerate a reduction reaction and an oxidation acceleration heat treatment step of heating, after the reduction acceleration heat treatment step, the reducing agent-applied area to accelerate an oxidation reaction, and the reducing agent-applied area is heated in the oxidation acceleration heat treatment step by contact heating or non-contact heating.

The conditions (a3) to (c3) correspond to the conditions (a1) to (c1) of the discharge printing device, respectively, and the condition (d3) corresponds to the conditions (d1) and (e1) of the discharge printing device.

DETAILED DESCRIPTION

The discharge printing device includes an application unit configured to apply a reducing agent to fabric; and a contact heating unit configured to subject a reducing agent-applied area to contact heating. The discharge printing device may be an integral-type discharge printing device including the application unit and the contact heating unit in one casing or a system independently including the application unit and the contact heating unit.

Figure 1:
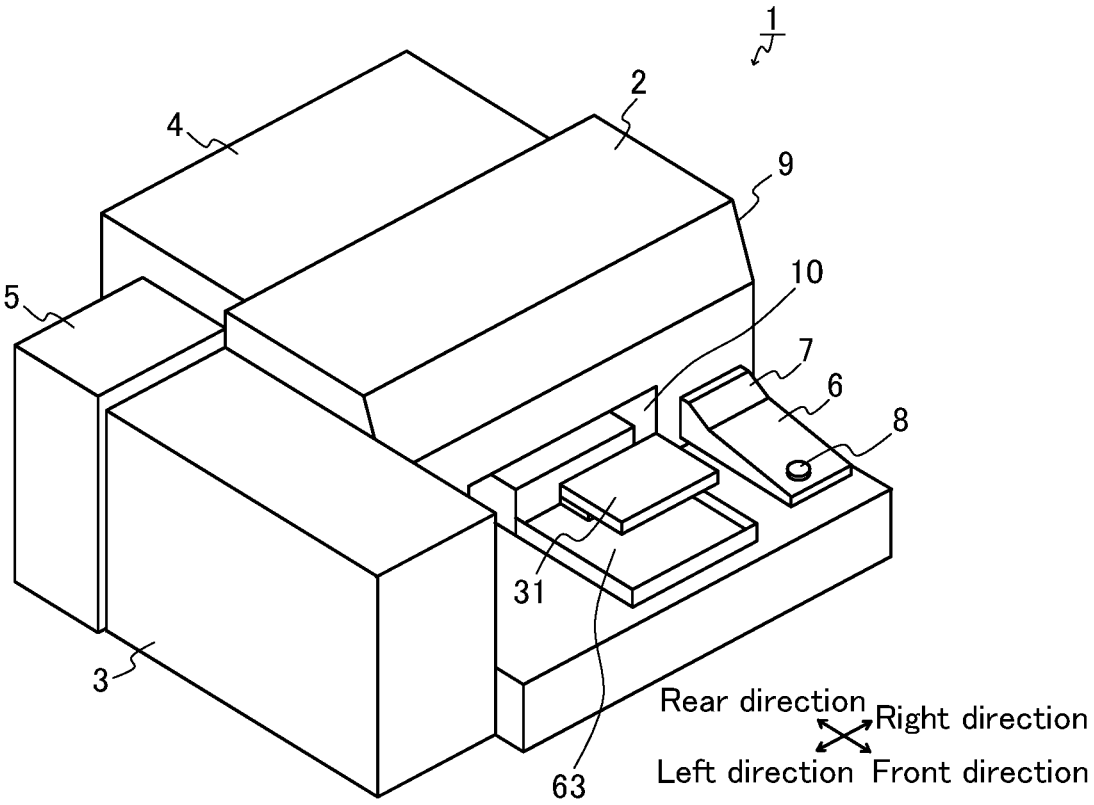
FIG. 1 is a perspective view illustrating an example configuration of a discharge printing device.

As shown in FIG. 1, the integral-type discharge printing device 1 includes an application section 2, a reducing agent storage section 3, a heat treatment section 4, and a control unit 5. The inside of the application section 2 is provided with the application unit as mentioned below. The inside of the heat treatment section 4 is provided with the contact heating unit as mentioned below.

An operation panel 6 including a display 7 and a button 8 is provided at the right front end of the application section 2. With the button 8, a discharge-printing start signal is input to the control unit 5. An opening 10 through which a platen 31 and fabric held on the platen 31 can be taken in or out is provided on the front wall of a casing 9 for the application section 2 and the heat treatment section 4. Hereinafter, the front, rear, left, and right directions are as indicated by arrows in FIG. 1.

Figure 2:
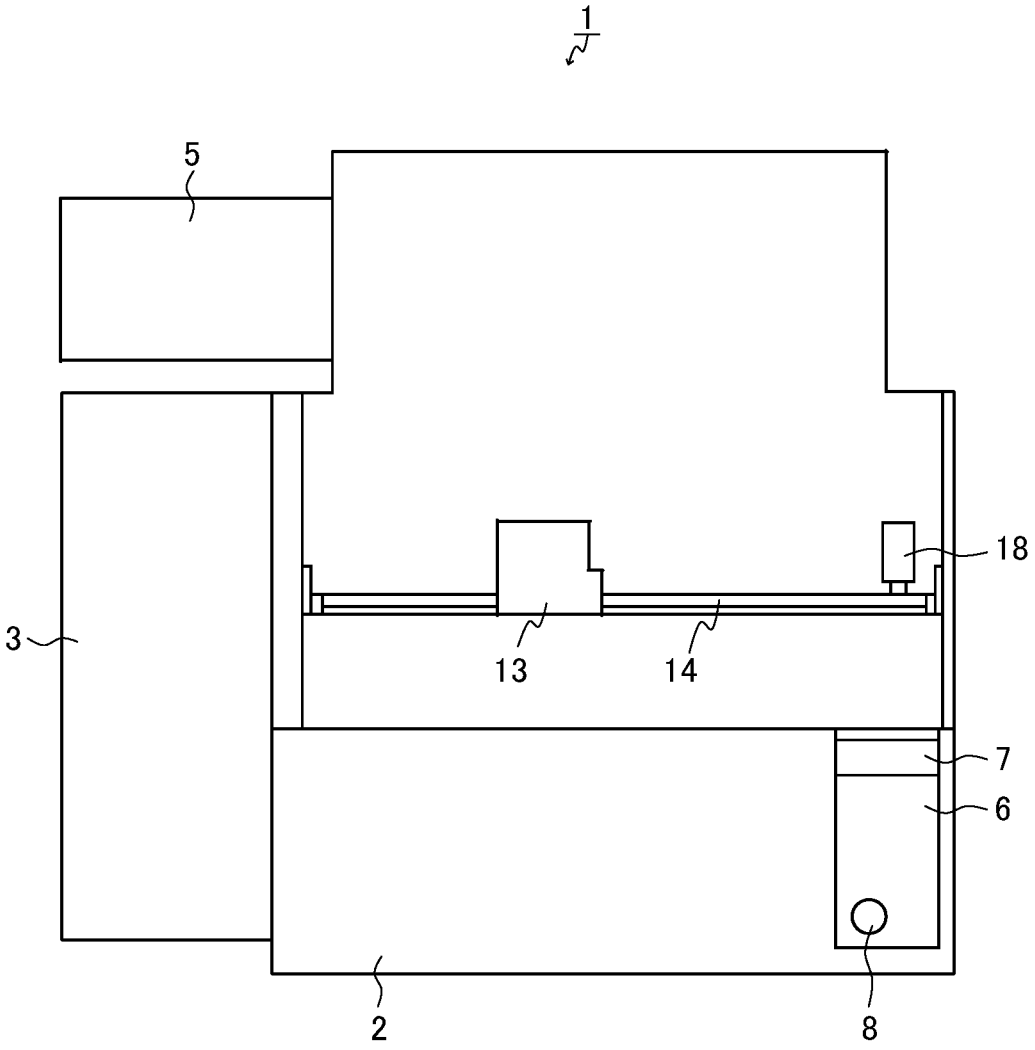
FIG. 2 is a plan view perspective illustrating the internal structures of an application section and a heat treatment section in the discharge printing device shown in FIG. 1.
Figure 3:
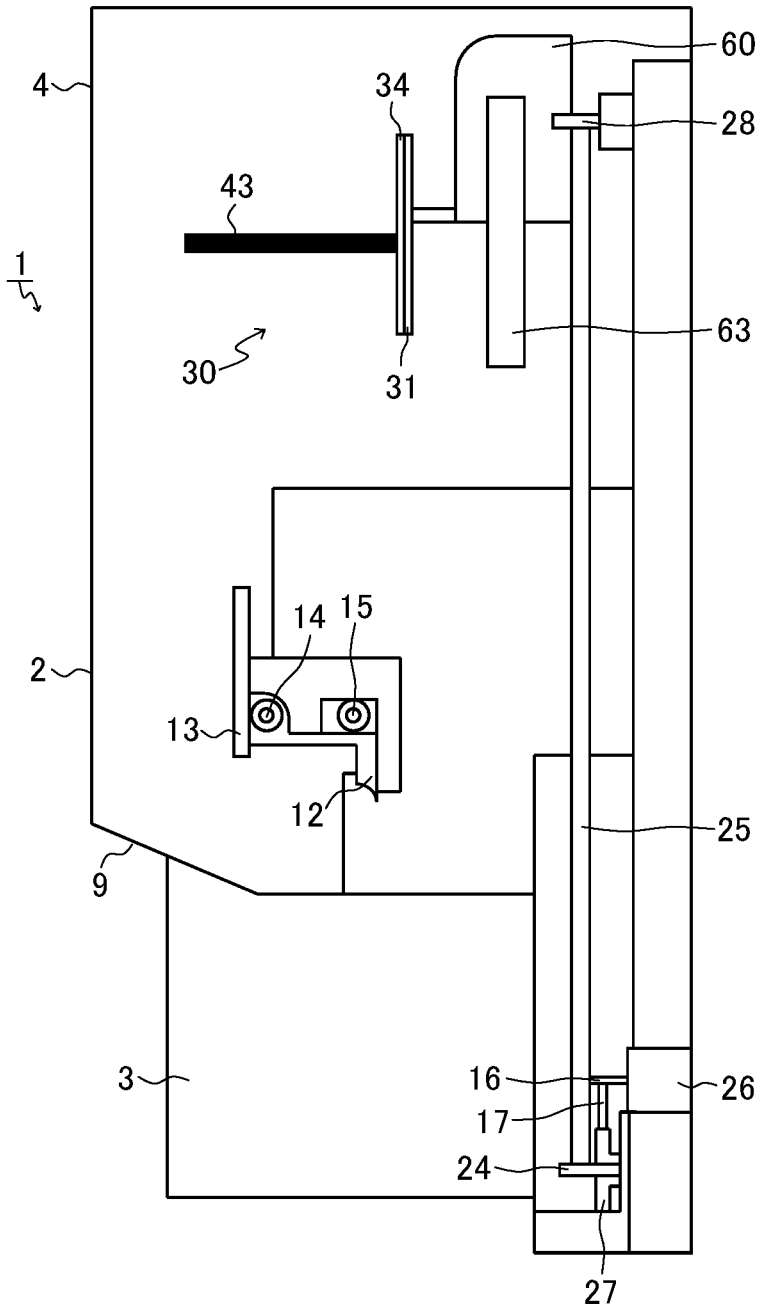
FIG. 3 is a side view perspective illustrating the internal structures of the application section and the heat treatment section in the discharge printing device shown in FIG. 1.

As shown in FIGS. 2 and 3, the inside of the application section 2 is provided with an application unit (liquid ejection head) 12 having an ink-jet nozzle line and a carriage 13 including this liquid ejection head 12. A pair of upper and lower guide rods 14 and 15 for guiding the carriage 13 are respectively disposed in the left-right direction.

A carriage motor 18 composed of a stepping motor that reciprocally conveys the carriage 13 in the left-right direction is provided at a right end of the guide rods 14 and 15. The carriage 13 is linked to a belt (not shown) set to be parallel with the guide rods 14 and 15. The belt is set to a pulley (not shown) linked to the carriage motor 18 and a pulley (not shown) provided at a left end of the guide rods 14 and 15. With the driving of the carriage motor 18, the liquid ejection head 12 and the carriage 13 are conveyed along the guide rods 14 and 15 in the left-right direction (main scanning direction). The carriage 13, the guide rods 14 and 15, the carriage motor 18, the pulleys, and the belt configure a liquid ejection head conveying mechanism.

A reducing agent storage container stored in the reducing agent storage section 3 is connected to the liquid ejection head 12 via a supply tube. FIGS. 1 to 3 show an example where the application unit is a liquid ejection head 12 having an ink-jet nozzle line. However, the application unit may be any unit as long as the unit can apply the reducing agent to fabric and may be, for example, a spray, a stamp for applying the reducing agent to fabric, a brush, or a roller.

A pair of left and right guide rails (not shown) for guiding a moving member 60 including the platen 31 is arranged in a row in the front-rear direction at the center in the left-right direction of the application section 2 and the heat treatment section 4. A tray 63 is fixed to the moving member 60 on the lower side of the platen 31.

A platen motor 26 is provided near the front end of the pair of left and right guide rails. A pulley 16 is fixed to the output shaft of the platen motor 26. A pulley 27 is supported at the bottom of the application section 2 on the front side of the platen motor 26. A belt 17 is set over the pulley 16 and pulley 27. The pulley 27 has a pulley 24 coaxially above the pulley 27. A pulley 28 is rotatably supported under the heat treatment section 4. A belt 25 is set over the pulley 24 and pulley 28. A moving member 60 is linked to the belt 25. The pulley 16 rotates by the rotational drive of the platen motor 26. With the rotation of the pulley 16, the pulley 24 is rotated via the belt 17. The rotation of the pulley 24 is transferred to the belt 25, and the moving member 60 is conveyed in the front-rear direction (subscanning direction) along the pair of left and right guide rails. The platen motor 26, the pair of left and right guide rails, the pulleys 16, 24, 27, and 28, and the belt 25 configure a platen conveying mechanism.

As shown in FIG. 3, the inside of the heat treatment section 4 is provided with a contact heating unit 30 configured to subject a reducing agent-applied area to contact heating. When the discharge printing device satisfies either of the condition (d1) and (e1), the contact heating unit 30 accelerates a reduction reaction by subjecting the reducing agent-applied area to contact heating. The contact heating unit 30 includes a heat press plate 34, an elastic support mechanism 43 for elastically supporting the heat press plate 34 so as to be slidable in the vertical direction, and a lifting drive mechanism (not shown) for vertically driving the heat press plate 34 so as to be able to move up and down detachably with respect to the surface of the fabric held by the platen 31. The heat press plate 34 may be composed of, for example, a heat insulating plate made of silicon rubber foam and a heat press section fixed to the bottom surface of the heat insulating plate. The heat press section may be composed of, for example, a heat sheet (heating section) including a nichrome wire arranged therein and a heat storage material made of iron, arranged so as to sandwich the heat sheet.

When the discharge printing device satisfies any of the conditions (a1), (b1), and (c1), the heat treatment section 4 may further include an intervening member that can be arranged between the reducing agent-applied area and the contact heating unit 30. Examples of the intervening member include moisture and heat retention members such as a polytetrafluoroethylene (PTFE)-impregnated glass cloth, cellulose, and silicone-resin-processed oil-resistant paper. Since the reduction reaction is considered to proceed in the presence of high-temperature moisture, it is considered to be important to prevent moisture and heat from escaping when discharge printing is performed by the contact heating. To accelerate the reduction reaction, a moisture and heat retention member is preferably intervened between the heat press section and the fabric. To also prevent dirt from adhering to the surface of the fabric and prevent the quality of the formed image from decreasing, the intervening member is preferably arranged when the heat press section and the surface of the fabric come into contact with each other. The higher the chroma C* of the reducing agent-applied area is, the more the fabric is considered to be colored. Although there is practically no problem in discharge printing ability, the chroma C* of the reducing agent-applied area becomes high with no moisture and heat retention member. It is assumed that the chroma C* is high because moisture and heat cannot be retained, so that efficiency of reducing dyes on the fabric is reduced, or dirt is adhered. With the use of the moisture and heat retention member, the chroma C* of the reducing agent-applied area becomes low, and there is practically no problem in discharge printing ability. To further improve discharge printing ability, cellulose is preferably used as the moisture and heat retention member. The chroma C* is obtained by the formula described in the examples to be described below.

When the discharge printing device satisfies the condition (e1), the heat treatment section 4 further includes a non-contact heating unit inside thereof. Examples of the non-contact heating unit include an oven and a belt conveyor oven. The non-contact heating unit may not be provided inside the heat treatment section 4 and may be provided independently from the discharge printing device 1.

Figure 4:
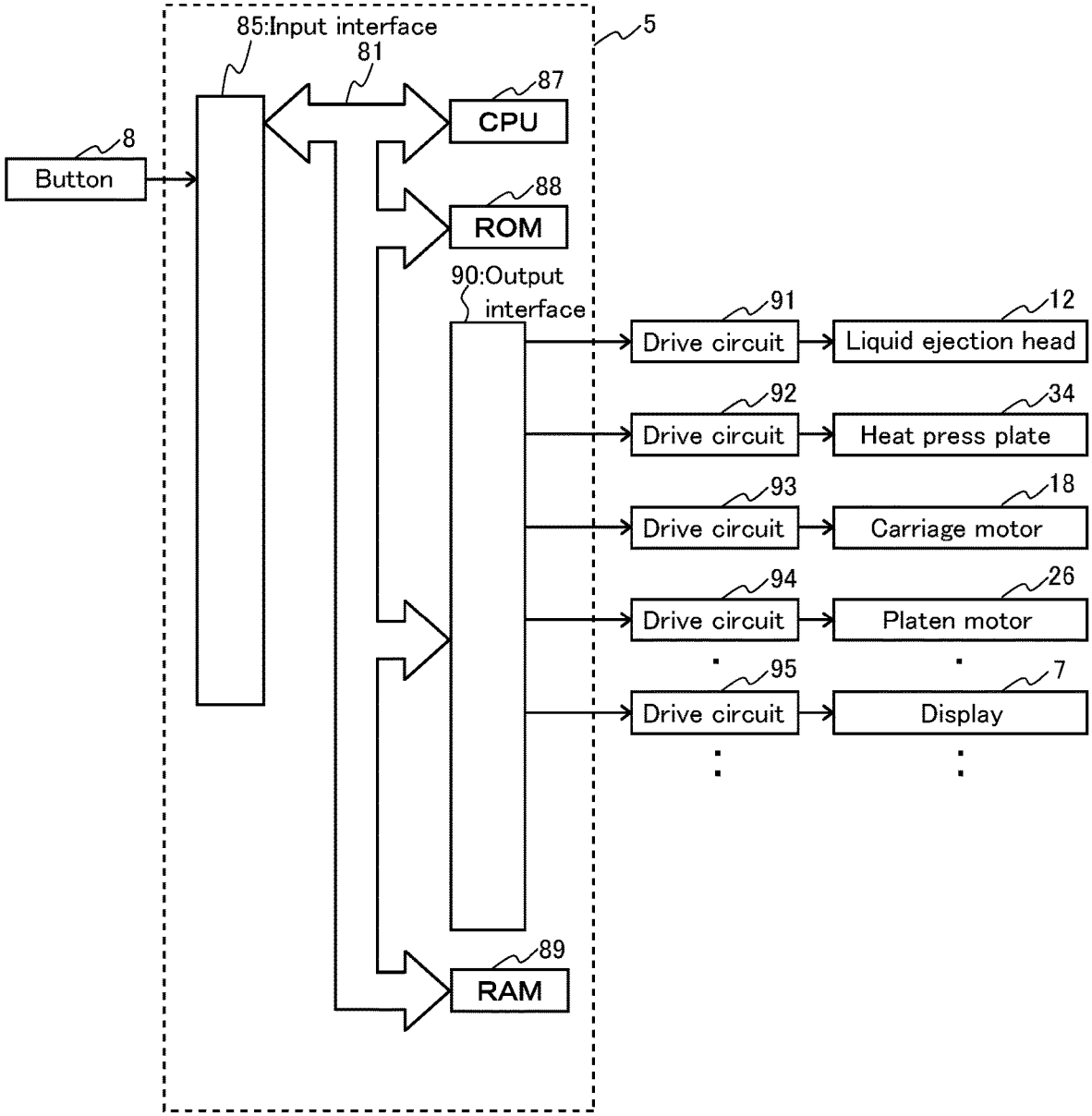
FIG. 4 is a block diagram showing an example configuration of a control unit of the discharge printing device shown in FIG. 1.

As shown in FIG. 4, in the control unit 5, a central processing unit (CPU) 87, a read only memory (ROM) 88, a random access memory (RAM) 89, an input interface 85, and an output interface 90 are electrically connected via a bus 81. The button 8 and the like are electrically connected to the input interface 85. The liquid ejection head 12, the heat press plate 34, the carriage motor 18, the platen motor 26, the display 7, and the like are electrically connected to the output interface 90 via drive circuits 91 to 95, respectively.

The CPU 87 performs various operations and processes based on signals input with the button 8 and various programs and data stored in the ROM 88 and the RAM 89. Then, data and the like are sent to each component of the application section 2 and the heat treatment section 4 via the output interface 90. The RAM 89 is a volatile storage device which is readable and writable and stores results of the operations and the like obtained in the CPU 87.

Fabric is discharge-printed by the discharge printing device of the present example as follows, for example. First, while a platen 31 and a liquid ejection head 12 are conveyed by the liquid ejection head conveying mechanism and the platen conveying mechanism, a reducing agent is applied to (ejected on) fabric. Examples of the reducing agent include sodium hydrosulfite, tiourea dioxide, Rongalite, sodium nitrite, sodium hydrogen sulfite, sodium thiosulfate, and sodium pyrosulfite. The reducing agent may be a reducing agent-containing liquid (may be either of a solution and a dispersion liquid). The concentration of the reducing agent in the reducing agent-containing liquid is, for example, 0.28 mol/l or more, 0.28 mol/l to 0.70 mol/l, 0.34 mol/l to 0.47 mol/l. The concentration of the reducing agent can be determined as follows. For example, an excess amount of an iodine solution is added to the reducing agent-containing liquid to cause the reducing agent-containing liquid and the iodine solution to completely react with each other, the extent of the remaining iodine of the excess amount of the iodine solution added is thereafter determined by back titration using another reducing liquid (for example, an aqueous sodium thiosulfate solution) with a known concentration, and the concentration of the reducing agent is determined according to the following formula. The reducing agent may be in a form of a discharge printing agent containing the reducing agent and a component other than the reducing agent such as a solvent, for example, water. The amount of the reducing agent to be applied to the fabric is, for example, 5 mg/cm$^2$ to 32 mg/cm$^2$, 5 mg/cm$^2$ to 25.2 mg/cm$^2$, 10.1 mg/cm$^2$ to 20.2 mg/cm$^2$.

Concentration of the reducing agent (mol/l)=[the concentration of the iodine solution (mol/l)×the amount of the iodine solution (ml) added]−[(the known concentration of the reducing solution (mol/l)×titer (ml))/$X$]

X: chemical equivalent of the reducing liquid having the known concentration to the iodine solution In the application step, the reducing agent is applied preferably to an area having substantially the same size as an area to be printed with an ink or is applied so that a reducing agent-applied area becomes smaller than the area to be printed with an ink.

Next, the fabric and the platen 31 are moved to the heat treatment section 4 by the driving of the platen motor 26, and the contact heating unit 30 is thereafter lowered by the lifting drive mechanism to press the fabric by the heat press plate 34 at a predetermined temperature for a predetermined time, whereby the reducing agent-applied area is subjected to contact heating. When either of the condition (d1) and (e1) is satisfied, the reduction reaction is accelerated by the contact heating of the reducing agent-applied area. A heating temperature and a heating time in the contact heating satisfy, for example, any of the following conditions (a1), (b1), or (c1): the condition (a1): the heating temperature is 100° C. or more and less than 150° C., and the heating time is 60 seconds or more; the condition (b1): the heating temperature is 150° C. or more and less than 170° C., and the heating time is 45 seconds or more; and the condition (c1): the heating temperature is 170° C. or more, and the heating time is 30 seconds or more.

When the reducing agent-applied area is subjected to contact heating under any of the conditions (a1) to (c1), the fabric can be sufficiently discharge-printed. From the viewpoint of preventing reducing agent-applied fabric from being brittle and burned, the heating temperature is, for example, preferably, 220° C. or less.

When any of the condition (a1), (b1) or (c1) is satisfied, the heating time in the contact heating is preferably 90 seconds or more from the viewpoint of improving a discharge printing ability, and is preferably 180 seconds or more from the viewpoint of preventing the discharge-printed fabric from being discolored. The upper limit of the heating time in the contact heating is, for example, 300 seconds or less.

When any of the condition (a1), (b1) or (c1) is satisfied, the contact heating unit 30 is lifted by the lifting drive mechanism to bring the fabric into contact with an atmosphere, whereby the discharge printing is completed. From the viewpoint of preventing the fabric discharge-printed by the contact heating from being discolored, the reducing agent-applied area is preferably heated again by a contact heating unit such as the heat press plate mentioned above or a non-contact heating unit after the discharge printing. Examples of the non-contact heating unit include an oven and a belt conveyor oven. The non-contact heating unit may be included inside the heat treatment section 4 or may be provided independently from the discharge printing device 1 without providing it inside the heat treatment section 4. The heating temperature in the heating after the discharge printing is, for example, 140° C. to 200° C. The heating time in the heating after the discharge printing is, for example, 15 seconds or more, 15 seconds to 180 seconds, 30 seconds to 90 seconds in the case of the contact heating, and is, for example, 60 seconds or more, 60 seconds to 300 seconds, 90 seconds to 180 seconds in the case of the non-contact heating.

It is assumed that the mechanism of preventing fabric discharge-printed by the contact heating from being discolored in the case where any of the condition (a1), (b1), or (c1) is satisfied is as follows, for example. That is, for example, thermal convection of water vapor in fibers occurs by contact heating using the contact heating unit such as the heat press plate mentioned above, and decolorization of dyes coloring the fabric caused by the reduction is accelerated. Thereafter, the contact heating unit is distanced from the fabric, and the water vapor in the fibers is diffused in atmosphere, whereby progress of the reduction reaction is terminated. Then, a second heat treatment using the contact heating unit or the non-contact heating unit is performed in the state where water vapor is not present in the fibers, whereby oxidation of the dyes is accelerated, and a discharge-printed area is slightly discolored to the extent that there is practically no problem, and subsequent discoloration is prevented. The present invention, however, is not limited to this presumption.

On the other hand, when either of the condition (d1) and (e1) is satisfied, the contact heating unit 30 is lifted by the lifting drive mechanism to terminate the reduction reaction.

When either of the condition (d1) and (e1) is satisfied, the contact heating unit 30 is subsequently lowered by the lifting drive mechanism to subject the reducing agent-applied area to contact heating by the heat press plate 34 at a predetermined temperature for a predetermined time, whereby the oxidation reaction is accelerated. It is preferred that the fabric is brought into contact with an atmosphere by lifting the contact heating unit 30 between the acceleration of the reduction reaction and the acceleration of the oxidation reaction. The reducing agent-applied area may be continuously subjected to contact heating for a predetermined time or more to accelerate the oxidation reaction after the acceleration of the reduction reaction without lifting or lowering the above-mentioned contact heating unit 30. The oxidation reaction may be accelerated by non-contact heating of the reducing agent-applied area by the above-mentioned non-contact heating unit as a substitute for the contact heating of the same by the contact heating unit 30. The heating temperature in the acceleration of the oxidation reaction is, for example, 140° C. to 200° C. The heating time in the acceleration of the oxidation reaction is, for example, 15 seconds or more, 15 seconds to 180 seconds, 30 seconds to 90 seconds in the case of the contact heating, and is, for example, 60 seconds or more, 60 seconds to 300 seconds, 90 seconds to 180 seconds in the case of the non-contact heating. The discharge-printed fabric can be prevented from being discolored by accelerating the oxidation reaction after the acceleration of the reduction reaction.

It is assumed that the mechanism of preventing fabric discharge-printed by the contact heating from being discolored in the case where either of the condition (d1) and (e1) is satisfied is as follows, for example. That is, for example, thermal convection of water vapor in fibers occurs by contact heating using the contact heating unit such as the heat press plate mentioned above, and decolorization of dyes coloring the fabric caused by the reduction is accelerated. Thereafter, the contact heating unit is distanced from the fabric, and the water vapor in the fibers is diffused in atmosphere, whereby progress of the reduction reaction is terminated. Then, a second heat treatment using the contact heating unit or the non-contact heating unit is performed in the state where water vapor is not present in the fibers, whereby oxidation of the dyes is accelerated, and a discharge-printed area is slightly discolored to the extent that there is practically no problem, and subsequent discoloration is prevented. It is also assumed that also in the case where the contact heating is continuously performed for a predetermined time or more without distancing the contact heating unit from the fabric, oxidation of the dyes is accelerated after acceleration of decolorization by reduction of the dyes, the discharge-printed area is slightly discolored to the extent that there is practically no problem, and subsequent discoloration is prevented. The present invention, however, is not limited to this presumption.

The ink-jet recording apparatus includes an ink ejecting unit configured to eject an ink and further includes a discharge printing device, and the discharge printing device is the above-described discharge printing device. In the discharge printing device shown in FIGS. 1 to 4 of the ink-jet recording apparatus, a liquid ejection head 12 may also serve as the ink ejecting unit. In the ink-jet recording apparatus of this aspect, for example, the reducing agent storage section 3 may further include five ink cartridges containing the respective inks of five colors (white, yellow, magenta, cyan, and black), and these ink cartridges may be connected to the liquid ejection head 12 via the respective ink supply tubes.

A first image forming method is a method for forming an image on fabric, including: a discharge printing step of subjecting fabric to discharge printing; an image printing step of printing, using an ink, an image on a discharge-printed area formed in the discharge printing step; and a heat-fixing step of thermally fixing the ink on the fabric, wherein the discharge printing step is performed by the above-described discharge printing method.

The first image forming method can be performed using the ink-jet recording apparatus including the above-mentioned discharge printing device shown in FIGS. 1 to 4, for example. First, fabric is discharge-printed by the above-mentioned discharge printing method.

Next, while a platen 31 and a liquid ejection head 12 are conveyed by the liquid ejection head conveying mechanism and the platen conveying mechanism, an image is printed on a discharge-printed area of the fabric using an ink. At least one of the ROM 88 or the RAM 89 in the control unit 5 of the ink-jet recording apparatus stores various pieces of image data created by software and various pieces of data of every kind of fabric such as a T-shirt. In response to the instruction of recording by an operator, the image data is sent to the liquid ejection head 12 via the output interface 90, inks are ejected from the liquid ejection head 12 based on this image data, and an image is printed on the fabric held on the platen 31.

Then, the fabric and the platen 31 are moved to the heat treatment section 4 by the driving of the platen motor 26, and the contact heating unit 30 is thereafter lowered by the lifting drive mechanism to press the fabric by the heat press plate 34 at a predetermined temperature for a predetermined time, whereby the ink is thermally fixed on the fabric. The heating temperature in the thermal fixing is, for example, 160° C. or more, 160° C. to 185° C. The heating time in the thermal fixing is, for example, 30 seconds or more, 30 seconds to 90 seconds, 45 seconds to 60 seconds.

A second image forming method is a method for forming an image on fabric, including: an application step of applying a reducing agent to fabric; and an image printing step of printing an image on an reducing agent-applied area using an ink, wherein the reducing agent-applied area is subjected to a heat treatment to subject the fabric to discharge printing, the method further includes a heat treatment step of thermally fixing the ink on the fabric, and the above-described reducing agent is used as the reducing agent. In the case where any of the condition (a1), (b1), or (c1) is satisfied, the second image forming method can be used, for example, as long as washing fastness is sufficient.

The second image forming method can be performed using the ink-jet recording apparatus including the above-mentioned discharge printing device shown in FIGS. 1 to 4, for example. First, a reducing agent is applied to fabric in the same manner as in the application step of the discharge printing method.

Next, while the platen 31 and the liquid ejection head 12 are conveyed by the liquid ejection head conveying mechanism and the platen conveyance mechanism, an image is printed on a reducing agent-applied area using an ink.

When any of the condition (a1), (b1), or (c1) is satisfied, the fabric and the platen 31 are moved to the heat treatment section 4 by the driving of the platen motor 26, and the contact heating unit 30 is thereafter lowered by the lifting drive mechanism to press the fabric by the heat press plate 34 at a predetermined temperature for a predetermined time, whereby the reducing agent-applied area is subjected to discharge printing, and the ink is thermally fixed on the fabric.

When any of the condition (a1), (b1), or (c1) is satisfied, a heat treatment is not required to be performed twice by the second image forming method, and an image can be formed in a shorter time.

On the other hand, when either of the condition (d1) and (e1) is satisfied, the fabric and the platen 31 are moved to the heat treatment section 4 by the driving of the platen motor 26, and the contact heating unit 30 is thereafter lowered by the lifting drive mechanism to press the fabric by the heat press plate 34 at a predetermined temperature for a predetermined time, whereby the reducing agent-applied area is subjected to a heat treatment, and the ink is thermally fixed on the fabric. The heating temperature in the heat treatment is, for example, 160° C. or more, 160° C. to 185° C. The heating time in the heat treatment is, for example, 30 seconds or more, 30 seconds to 90 seconds, 45 seconds to 60 seconds. Thereafter, the reducing agent-applied area is subjected to contact heating or non-contact heating to subject the fabric to discharge printing.

A method for producing fabric is a method for producing fabric having an image and includes the step of forming an image on fabric by the image forming method.

When any of the condition (a1), (b1), and (c1) is satisfied, fabric which has been sufficiently subjected to discharge printing can be obtained by the method for forming an image and the method for producing fabric.

When either of the condition (d1) and (e1) is satisfied, a discharge printed fabric is prevented from being discolored by the method for forming an image and the method for producing fabric, whereby fabric with good appearance where traces of applied discharge printing agent are not noticeable can be obtained.

EXAMPLES

The examples are described below together with comparative examples. The present invention, however, is by no means limited thereto.

Example 1-1

To a black T shirt (material: 100% cotton), 20.5 mg/cm$^2$ of a discharge printing agent was applied, and a discharge printing agent-applied area was subjected to contact heating using a heat press machine. In the contact heating, the heating time was 60 seconds, and the heating temperature was 100° C. A L* value of the discharge-printed area was measured using a CIE1976L*a*b* color space scale colorimeter X-Rite939 manufactured by X-Rite Corporation.

(Composition of Discharge Printing Agent)

| | |
|---|---|
| Tiourea dioxide | 7.5 wt % |
| Disodium malonate | 5 wt % |

-continued

| | |
|---|---|
| 2-amino-2-methyl-1-propanol | 10 wt % |
| Water | Balance |

Examples 1-2 to 1-15 and Comparative Examples 1-1 to 1-5

L* values were measured in the same manner as in Example 1-1 except that the heating temperature and the heating time in the contact heating were changed to those summarized in Table 1.

The discharge printing ability in Examples 1-1 to 1-15 and Comparative Examples 1-1 to 1-5 were evaluated according to the following evaluation criteria.

Discharge Printing Ability Evaluation

Evaluation Criteria:

A: L* value immediately after the contact heating is 70 or more.

B: L* value immediately after the contact heating is 60 or more and less than 70.

C: L* value immediately after the contact heating is 55 or more and less than 60.

D: L* value immediately after the contact heating is less than 55.

Table 1 summarizes evaluation results of Examples 1-1 to 1-15 and Comparative Examples 1-1 to 1-5.

TABLE 1

| | Examples | | | | | | | | |
|---|---|---|---|---|---|---|---|---|---|
| | 1-1 | 1-2 | 1-3 | 1-4 | 1-5 | 1-6 | 1-7 | 1-8 | 1-9 |
| Contact heating temperature (° C.) | 100 | 140 | 150 | | | 160 | | 170 | |
| Contact heating time (sec) | 60 | 60 | 45 | 60 | 45 | 60 | 30 | 45 | 60 |
| L* | 66.73 | 66.13 | 65.79 | 68.87 | 67.76 | 70.11 | 64.64 | 70.86 | 74.62 |
| Discharge printing ability | B | B | B | B | B | A | B | A | A |

| | Examples | | | | | |
|---|---|---|---|---|---|---|
| | 1-10 | 1-11 | 1-12 | 1-13 | 1-14 | 1-15 |
| Contact heating temperature (° C.) | | 180 | | | 200 | |
| Contact heating time (sec) | 30 | 45 | 60 | 30 | 45 | 60 |
| L* | 68.86 | 70.68 | 76.46 | 77.46 | 80.43 | 81.37 |
| Discharge printing ability | B | A | A | A | A | A |

| | Comparative Examples | | | | |
|---|---|---|---|---|---|
| | 1-1 | 1-2 | 1-3 | 1-4 | 1-5 |
| Contact heating temperature (° C.) | 80 | 140 | | 150 | 160 |
| Contact heating time (sec) | 60 | 30 | 45 | 30 | 30 |
| L* | 54.88 | 21.08 | 51.38 | 53.37 | 59.82 |
| Discharge printing ability | D | D | D | D | C |

As summarized in Table 1, Examples 1-1 to 1-15 showed good results in the discharge printing ability evaluation. In contrast, Comparative Example 1 where a heating temperature was low, and none of the conditions (a1) to (c1) was satisfied and Comparative Examples 1-2 to 1-5 where a heating time relative to the heating temperature was low, and none of the conditions (a1) to (c1) was satisfied showed bad results in the discharge printing ability evaluation.

Example 2-1

To a black T shirt (material: 100% cotton), 20.5 mg/cm$^2$ of a discharge printing agent which is the same as used in Examples 1-1 and 1-2 and Comparative Example 1-1 was applied, and a discharge printing agent-applied area was subjected to contact heating using a heat press machine. At that time, a PTFE-impregnated glass cloth was intervened between the T shirt and the heat press machine. In the contact heating, the heating temperature was 180° C., and the heating time was 45 seconds. A L* value, a a* value, and a b* value of discharge-printed area were measured using a CIE1976L*a*b* color space scale colorimeter X-Rite939 manufactured by X-Rite Corporation, and a color difference ΔE*ab was calculated by the following equation.

$$\Delta E^*ab=\{(L_1^*-L_2^*)^2+(a_1^*-a_2^*)^2+(b_1^*-b_2^*)^2\}^{1/2}$$

$L_1$*: L* value of the discharge-printed area after 7 days.

$L_2$*: L* value of the discharge-printed area immediately after the contact heating.

$a_1$*: a* value of the discharge-printed area after 7 days.

$a_2$*: a* value of the discharge-printed area immediately after the contact heating.

$b_1$*: b* value of the discharge-printed area after 7 days.

$b_2$*: b* value of the discharge-printed area immediately after the contact heating.

Examples 2-2 to 2-7

L* values, a* values, and b* values were measured, and color differences ΔL*ab were calculated in the same manner as in Example 2-1 except that the heating time in the contact heating was changed to those summarized in Table 2. In Table 2, 0 in the section of the number of elapsed days means immediately after the contact heating.

The discharge printing ability and the discoloration prevention in Examples 2-1 to 2-7 were evaluated according to the following evaluation criteria.

Discharge Printing Ability Evaluation

Evaluation Criteria:

A: L* value immediately after the contact heating is 70 or more.

B: L* value immediately after the contact heating is 60 or more and less than 70.

C: L* value immediately after the contact heating is 55 or more and less than 60.

D: L* value immediately after the contact heating is less than 55.

Discoloration Prevention Evaluation

Evaluation Criteria:

A: ΔE*ab value is less than 3.0.

B: ΔE*ab value is 3.0 or more and less than 5.0.

C: ΔE*ab value is 5.0 or more and less than 10.0.

D: ΔE*ab value is 10.0 or more.

Table 2 summarizes the evaluation results of Examples 2-1 to 2-7.

TABLE 2

| | Examples | | | | | | | | | | | | | |
|---|---|---|---|---|---|---|---|---|---|---|---|---|---|---|
| | 2-1 | | 2-2 | | 2-3 | | 2-4 | | 2-5 | | 2-6 | | 2-7 | |
| Contact heating temperature (° C.) | 180 | | 180 | | 180 | | 180 | | 180 | | 180 | | 180 | |
| Contact heating time (sec) | 45 | | 60 | | 90 | | 120 | | 150 | | 180 | | 300 | |
| The number of elapsed days (day) | 0 | 7 | 0 | 7 | 0 | 7 | 0 | 7 | 0 | 7 | 0 | 7 | 0 | 7 |
| L* | 61.87 | 49.53 | 64.68 | 54.87 | 72.14 | 66.43 | 76.28 | 70.49 | 75.92 | 70.98 | 78.45 | 75.10 | 77.36 | 74.67 |
| a* | −0.39 | 4.82 | 2.80 | 6.92 | 2.82 | 4.66 | 2.71 | 4.54 | 3.32 | 4.50 | 1.96 | 2.86 | 2.01 | 3.01 |
| b* | 9.32 | 13.98 | 13.41 | 16.81 | 14.59 | 15.67 | 14.59 | 18.35 | 18.72 | 18.76 | 19.76 | 21.60 | 18.89 | 18.71 |
| ΔE*ab | 14.18 | | 11.17 | | 6.09 | | 6.07 | | 5.08 | | 3.93 | | 2.88 | |
| Discharge printing ability | B | | B | | A | | A | | A | | A | | A | |
| Discoloration prevention | D | | D | | C | | C | | C | | B | | A | |

As summarized in Table 2, Examples 2-1 to 2-7 showed good results in the discharge printing ability evaluation. Examples 2-3 to 2-7 where the heating time in the contact heating was 90 seconds or more showed better results in the discharge printing ability evaluation than Examples 2-1 and 2-2 where the heating time in the contact heating was less than 90 seconds. Moreover, Examples 2-6 and 2-7 where the heating time in the contact heating was 180 seconds or more showed better results in the discoloration prevention evaluation than Examples 2-1 to 2-5 where the heating time in the contact heating was less than 180 seconds.

Examples 3-1 to 3-3

The discharge printing ability and the discoloration prevention were evaluated in the same manner as in Example 2-2 except that cellulose or silicone-resin-processed oil-resistant paper was intervened, or no moisture and heat retention member was intervened between the T shirt and the heat press machine, and evaluation results were compared with those of Example 2-2. In Table 3, the chroma C* was obtained by the following equation.

$$C^*=(a^{*2}+b^{*2})^{1/2}$$

Table 3 summarizes the evaluation results of Examples 2-2 and 3-1 to 3-3.

TABLE 3

| | Examples | | | |
|---|---|---|---|---|
| | 2-2 | 3-1 | 3-2 | 3-3 |
| Contact heating temperature (° C.) | 180 | 180 | 180 | 180 |
| Contact heating time (sec) | 60 | 60 | 60 | 60 |

TABLE 3-continued

| | Examples | | | |
|---|---|---|---|---|
| | 2-2 | 3-1 | 3-2 | 3-3 |
| L* | 64.68 | 75.58 | 69.48 | 69.65 |
| a* | 2.80 | 0.52 | 3.07 | 4.62 |
| b* | 13.41 | 14.53 | 14.58 | 17.42 |
| Chroma C* | 13.70 | 14.54 | 14.90 | 18.02 |

TABLE 3-continued

| | Examples | | | |
|---|---|---|---|---|
| | 2-2 | 3-1 | 3-2 | 3-3 |
| Intervening member | PTFE-impregnated glass cloth | Cellulose | Silicone resin-processed oil-resistant paper | None |
| Discharge printing ability | B | A | B | B |

As summarized in Table 3, Examples 2-2, 3-1, and 3-2 where a moisture and heat retention member was intervened between the T shirt and the heat press machine showed lower chromas C* than Example 3-3 where no moisture and heat retention member was intervened.

Example 4-1

In the same manner as in Example 2-1, a discharge printing agent was applied to a T shirt, and a discharge printing agent-applied area was subjected to contact heating using a heat press machine. The T shirt was thereafter brought into contact with an atmosphere, and the discharge printing agent-applied area was then subjected to contact heating using a heat press machine set at 180° C. for 15 seconds. A L* value, a a* value, and a b* value of the discharge-printed area were measured immediately after this second contact heating and after 7 days from this second contact heating using the colorimeter X-Rite939, and a color difference ΔL*ab was calculated by the following equation.

$$\Delta E^*ab=\{(L_1^*-L_2^*)^2+(a_1^*-a_2^*)^2+(b_1^*-b_2^*)^2\}^{1/2}$$

$L_1^*$: L* value of the discharge-printed area after 7 days.

$L_2^*$: L* value of the discharge-printed area immediately after the second contact heating.

$a_1^*$: a* value of the discharge-printed area after 7 days.

$a_2$*: a* value of the discharge-printed area immediately after the second contact heating.

$b_1$*: b* value of the discharge-printed area after 7 days.

$b^2$*: b* value of the discharge-printed area immediately after the second contact heating.

Examples 4-2 to 4-12

L* values, a* values, and b* values were measured, and color differences ΔL*ab were calculated in the same manner as in Example 2-1 except that the heating time in each of the first contact heating and the second contact heating was changed to those summarized in Table 4.

The discharge printing ability and the discoloration prevention in Examples 4-1 to 4-12 were evaluated according to the following evaluation criteria.

Discharge Printing Ability Evaluation

Evaluation Criteria:

A: L* value immediately after the acceleration of oxidation reaction is 70 or more.

B: L* value immediately after the acceleration of oxidation reaction is 60 or more and less than 70.

C: L* value immediately after the acceleration of oxidation reaction is 55 or more and less than 60.

D: L* value immediately after he acceleration of oxidation reaction is less than 55.

Discoloration Prevention Evaluation

Evaluation Criteria:

A: ΔE*ab value is less than 3.0.

B: ΔE*ab value is 3.0 or more and less than 5.0.

C: ΔE*ab value is 5.0 or more and less than 10.0.

D: ΔE*ab value is 10.0 or more.

Table 4 summarizes the evaluation results of Examples 4-1 to 4-12. In Table 4, Contact 1 means the first contact heating, and Contact 2 means the second contact heating.

TABLE 4

| | | Heating time (sec) | | The number of elapsed | | | | | Evaluation | |
|---|---|---|---|---|---|---|---|---|---|---|
| | | Contact 1 | Contact 2 | days (day) | L* | a* | b* | ΔE*ab | Discharge printing ability | Discoloration prevention |
| Examples | 4-1 | 45 | 15 | 0 | 60.77 | 4.85 | 14.98 | 0.57 | B | A |
| | | | | 7 | 60.69 | 4.43 | 14.60 | | | |
| | 4-2 | | 30 | 0 | 63.84 | 5.03 | 16.10 | 1.60 | B | A |
| | | | | 7 | 62.50 | 4.57 | 15.37 | | | |
| | 4-3 | 60 | 15 | 0 | 63.26 | 3.93 | 13.50 | 0.62 | B | A |
| | | | | 7 | 63.60 | 4.01 | 14.01 | | | |
| | 4-4 | | 30 | 0 | 62.74 | 3.88 | 14.02 | 1.66 | B | A |
| | | | | 7 | 63.52 | 3.74 | 12.56 | | | |
| | 4-5 | | 60 | 0 | 63.58 | 3.70 | 14.65 | 1.30 | B | A |
| | | | | 7 | 63.98 | 4.12 | 13.49 | | | |
| | 4-6 | | 90 | 0 | 66.31 | 4.52 | 18.16 | 1.70 | B | A |
| | | | | 7 | 65.41 | 4.84 | 16.75 | | | |
| | 4-7 | 90 | 30 | 0 | 74.33 | 3.23 | 17.54 | 2.32 | A | A |
| | | | | 7 | 72.30 | 4.02 | 16.73 | | | |
| | 4-8 | | 60 | 0 | 74.18 | 3.04 | 17.34 | 3.08 | A | B |
| | | | | 7 | 71.30 | 4.10 | 17.02 | | | |
| | 4-9 | | 90 | 0 | 71.13 | 3.40 | 18.19 | 1.62 | A | A |
| | | | | 7 | 69.71 | 3.89 | 17.58 | | | |
| | 4-10 | 180 | 30 | 0 | 71.66 | 3.85 | 18.00 | 1.39 | A | A |
| | | | | 7 | 70.32 | 4.05 | 17.72 | | | |
| | 4-11 | | 60 | 0 | 74.46 | 2.70 | 17.61 | 1.70 | A | A |
| | | | | 7 | 72.87 | 3.08 | 17.16 | | | |
| | 4-12 | | 90 | 0 | 71.94 | 3.24 | 17.92 | 0.60 | A | A |
| | | | | 7 | 71.63 | 3.44 | 17.44 | | | |

As summarized in Table 4, Examples 4-1 to 4-12 showed good results in both of the discharge printing ability evaluation and the discoloration prevention evaluation.

Examples 5-1 to 5-10

L* values, a* values, and b* values were measured, and color differences ΔL*ab were calculated in the same manner as in Examples 4-1 to 4-12 except that non-contact heating using an oven set at 160° C. was performed as a substitute for the second contact heating using a heat press machine set at 180° C., and the discharge printing ability and the discoloration prevention were evaluated in the same manner as in Examples 4-1 to 4-12.

Table 5 summarizes the evaluation results of Examples 5-1 to 5-10. In Table 5, Contact means contact heating, and Non-contact means non-contact heating.

TABLE 5

| | | Heating time (sec) | | The number | | | | | Evaluation | |
|---|---|---|---|---|---|---|---|---|---|---|
| | | Contact | Non-contact | of elapsed days | L* | a* | b* | ΔE*ab | Discharge printing ability | Discoloration prevention |
| Examples | 5-1 | 45 | 30 | 0 | 63.22 | 2.09 | 10.88 | 4.19 | B | B |
| | | | | 7 | 61.55 | 4.41 | 13.95 | | | |
| | 5-2 | 60 | 30 | 0 | 66.43 | 2.31 | 11.56 | 3.64 | B | B |
| | | | | 7 | 64.20 | 4.32 | 13.65 | | | |
| | 5-3 | | 60 | 0 | 65.48 | 2.24 | 12.45 | 2.60 | B | A |
| | | | | 7 | 63.71 | 3.76 | 13.60 | | | |
| | 5-4 | | 90 | 0 | 63.79 | 3.44 | 13.06 | 1.73 | B | A |
| | | | | 7 | 62.11 | 3.86 | 13.19 | | | |
| | 5-5 | | 180 | 0 | 62.38 | 4.08 | 15.75 | 2.55 | B | A |
| | | | | 7 | 63.65 | 3.60 | 13.60 | | | |
| | 5-6 | 90 | 60 | 0 | 69.37 | 2.74 | 14.28 | 3.16 | B | B |
| | | | | 7 | 66.30 | 3.47 | 14.56 | | | |
| | 5-7 | | 90 | 0 | 63.76 | 2.97 | 11.83 | 1.70 | B | A |
| | | | | 7 | 62.22 | 3.56 | 12.23 | | | |
| | 5-8 | | 180 | 0 | 65.70 | 4.07 | 16.12 | 1.62 | B | A |
| | | | | 7 | 64.83 | 3.99 | 14.75 | | | |
| | 5-9 | 180 | 60 | 0 | 81.16 | 0.51 | 17.37 | 2.05 | A | A |
| | | | | 7 | 79.62 | 1.24 | 18.49 | | | |
| | 5-10 | | 180 | 0 | 76.79 | 2.30 | 18.23 | 1.29 | A | A |
| | | | | 7 | 75.77 | 2.62 | 18.95 | | | |

As summarized in Table 5, Examples 5-1 to 5-10 showed good results in both of the discharge printing ability evaluation and the discoloration prevention evaluation.

Reference Example

To a black T shirt (material: 100% cotton), 20.5 mg/cm$^2$ of a discharge printing agent which has the same composition as used in Examples 1-1 and 1-2 and Comparative Example 1-1 was applied, and a discharge printing agent-applied area was subjected to contact heating using a heat press machine to accelerate a reduction reaction. For the acceleration of the reduction reaction, the heating temperature was 80° C., 100° C., 140° C., 150° C., 160° C., 170° C., 180° C., and 200° C., the heating time was 30 seconds, 45 seconds, and 60 seconds, and the L* values of the discharge-printed area under the respective conditions were measured using the colorimeter X-Rite939. Table 6 summarizes the measurement results.

TABLE 6

| | | Heating temperature (° C.) in acceleration of reduction reaction | | | | | | | |
|---|---|---|---|---|---|---|---|---|---|
| | | 80 | 100 | 140 | 150 | 160 | 170 | 180 | 200 |
| Heating time (sec) in acceleration of reduction reaction | 30 | — | — | 21.08 | 53.37 | 59.82 | 64.64 | 68.86 | 77.46 |
| | 45 | — | — | 51.38 | 65.79 | 67.76 | 70.86 | 70.68 | 80.43 |
| | 60 | 54.88 | 66.73 | 66.13 | 68.67 | 70.11 | 74.62 | 76.46 | 81.37 |

As summarized in Table 6, it was found that the degree of discharge printing depends on the heating temperature and the heating time in acceleration of the reduction reaction, and the heating temperature and the heating time can be set, as appropriate, according to the desired L* value (for example, 60 or more).

Example 6-1

A reduction reaction was accelerated in the same manner as in Reference Example except that the heating temperature was 180° C., and the heating time was 45 seconds. The T shirt was thereafter brought into contact with an atmosphere, and the discharge printing agent-applied area was then subjected to contact heating using a heat press machine set at 180° C. for 15 seconds to accelerate an oxidation reaction. A L* value, a a* value, and a b* value of the discharge-printed area were measured immediately after this contact heating and after 7 days from this contact heating using the colorimeter X-Rite939, and a color differences ΔL*ab was calculated by the following equation.

$$\Delta E^*ab=\{(L_1^*-L_2^*)^2+(a_1^*-a_2^*)^2+(b_1^*-b_2^*)^2\}^{1/2}$$

$L_1^*$: L* value of the discharge-printed area after 7 days.
$L_2^*$: L* value of the discharge-printed area immediately after the acceleration of oxidation reaction.
$a_1^*$: a* value of the discharge-printed area after 7 days.
$a_2^*$: a* value of the discharge-printed area immediately after the acceleration of oxidation reaction.
$b_1^*$: b* value of the discharge-printed area after 7 days.
$b_2^*$: b* value of the discharge-printed area immediately after the acceleration of oxidation reaction.

Examples 6-2 to 6-13

L* values, a* values, and b* values were measured, and color differences ΔL*ab were calculated in the same manner as in Example 6-1 except that the heating times in acceleration of the reduction reaction and the oxidation reaction were changed to those summarized in Table 7. Note here that in Example 6-13, the oxidation reaction was accelerated after the acceleration of the reduction reaction by continuously performing contact heating for 180 seconds without bringing the T shirt into contact with an atmosphere between the acceleration of the reduction reaction and the acceleration of the oxidation reaction.

Comparative Examples 6-1 to 6-3

A reduction reaction was accelerated in the same manner as in Reference Example except that the heating temperature and the heating time were changed to those summarized in Table 7.

The discharge printing ability and the discoloration prevention in Examples 6-1 to 6-13 and Comparative Examples 6-1 to 6-3 were evaluated in the same manner as in Examples 4-1 to 4-12.

Table 7 summarizes evaluation results of Examples 6-1 to 6-13 and Comparative Examples 6-1 to 6-3. In Table 7, Reduction means the acceleration of the reduction reaction, Oxidation means the acceleration of the oxidation reaction, 0 seconds of the heating time in acceleration of the oxidation reaction means that the acceleration of the oxidation reaction was not performed, and 0 day of the number of elapsed days means immediately after the acceleration of the oxidation reaction (and means immediately after the acceleration of the reduction reaction when the acceleration of the oxidation reaction was not performed).

TABLE 7

| | | Heating time (sec) | | The number of elapsed | | | | | Evaluation | |
|---|---|---|---|---|---|---|---|---|---|---|
| | | Reduction | Oxidation | days | L* | a* | b* | ΔE*ab | Discharge printing ability | Discoloration prevention |
| Ex. | 6-1 | 45 | 15 | 0 | 60.77 | 4.85 | 14.98 | 0.57 | B | A |
| | | | | 7 | 60.69 | 4.43 | 14.60 | | | |
| | 6-2 | | 30 | 0 | 63.84 | 5.03 | 16.10 | 1.60 | B | A |
| | | | | 7 | 62.50 | 4.57 | 15.37 | | | |
| | 6-3 | 60 | 15 | 0 | 63.26 | 3.93 | 13.50 | 0.62 | B | A |
| | | | | 7 | 63.60 | 4.01 | 14.01 | | | |
| | 6-4 | | 30 | 0 | 62.74 | 3.88 | 14.02 | 1.66 | B | A |
| | | | | 7 | 63.52 | 3.74 | 12.56 | | | |
| | 6-5 | | 60 | 0 | 63.58 | 3.70 | 14.65 | 1.30 | B | A |
| | | | | 7 | 63.98 | 4.12 | 13.49 | | | |
| | 6-6 | | 90 | 0 | 66.31 | 4.52 | 18.16 | 1.70 | B | A |
| | | | | 7 | 65.41 | 4.84 | 16.75 | | | |
| | 6-7 | 90 | 30 | 0 | 74.33 | 3.23 | 17.54 | 2.32 | A | A |
| | | | | 7 | 72.30 | 4.02 | 16.73 | | | |
| | 6-8 | | 60 | 0 | 74.18 | 3.04 | 17.34 | 3.08 | A | B |
| | | | | 7 | 71.30 | 4.10 | 17.02 | | | |
| | 6-9 | | 90 | 0 | 71.13 | 3.40 | 18.19 | 1.62 | A | A |
| | | | | 7 | 69.71 | 3.89 | 17.58 | | | |
| | 6-10 | 180 | 30 | 0 | 71.66 | 3.85 | 18.00 | 1.39 | A | A |
| | | | | 7 | 70.32 | 4.05 | 17.72 | | | |
| | 6-11 | | 60 | 0 | 74.46 | 2.70 | 17.61 | 1.70 | A | A |
| | | | | 7 | 72.87 | 3.08 | 17.16 | | | |
| | 6-12 | | 90 | 0 | 71.94 | 3.24 | 17.92 | 0.60 | A | A |
| | | | | 7 | 71.63 | 3.44 | 17.44 | | | |
| | 6-13 | 180 | | 0 | 78.45 | 1.96 | 19.76 | 3.93 | A | B |
| | | | | 7 | 75.10 | 2.86 | 21.60 | | | |
| Comp. Ex. | 6-1 | 45 | 0 | 0 | 61.87 | −0.39 | 9.32 | 14.18 | B | D |
| | | | | 7 | 49.53 | 4.82 | 13.98 | | | |
| | 6-2 | 60 | 0 | 0 | 64.48 | 2.80 | 13.41 | 11.17 | B | D |
| | | | | 7 | 54.87 | 6.92 | 16.81 | | | |
| | 6-3 | 90 | 0 | 0 | 72.41 | 2.82 | 14.59 | 6.09 | A | C |
| | | | | 7 | 66.43 | 4.66 | 15.67 | | | |

As summarized in Table 7, Examples 6-1 to 6-13 showed good results in both of the discharge printing ability evaluation and the discoloration prevention evaluation. Example 6-9 where the T shirt was brought into contact with an atmosphere between the acceleration of the reduction reaction for 90 seconds and the acceleration of the oxidation reaction for 90 seconds showed better results in the discoloration prevention evaluation than Example 6-13 where the oxidation reaction was accelerated after the acceleration of the reduction reaction by continuously performing contact heating for 180 seconds without bringing the T shirt into contact with an atmosphere between the acceleration of the reduction reaction and the acceleration of the oxidation reaction. It is assumed that in Example 6-13, the contact heating was continuously performed for a predetermined time or more without distancing the T shirt (fabric) from the heat press machine (contact heating unit) as mentioned above, and oxidation of dyes was thus accelerated after acceleration of decolorization caused by the reduction of the dyes, a discharge-printed area was slightly discolored to the extent that there was practically no problem, and subsequent discoloration was prevented. In contract, Comparative Examples 6-1 to 6-3 where acceleration of the oxidation reaction was not performed showed bad results in the discoloration prevention evaluation.

Examples 7-1 to 7-10

L* values, a* values, and b* values were measured, and color differences ΔL*ab were calculated in the same manner as in Examples 6-1 to 6-12 except that non-contact heating using an oven set at 160° C. was performed as a substitute for the contact heating using a heat press machine set at 180° C., and the discharge printing ability and the discoloration prevention were evaluated in the same manner as in Examples 6-1 to 6-12.

Table 8 summarizes the evaluation results of Examples 7-1 to 7-10.

TABLE 8

| | | Heating time (sec) | | The number of elapsed | | | | | Evaluation | |
|---|---|---|---|---|---|---|---|---|---|---|
| | | Reduction | Oxidation | days | L* | a* | b* | ΔE*ab | Discharge printing ability | Discoloration prevention |
| Examples | 7-1 | 45 | 30 | 0 | 63.22 | 2.09 | 10.88 | 4.19 | B | B |
| | | | | 7 | 61.55 | 4.41 | 13.95 | | | |
| | 7-2 | 60 | 30 | 0 | 66.43 | 2.31 | 11.56 | 3.64 | B | B |
| | | | | 7 | 64.20 | 4.32 | 13.65 | | | |
| | 7-3 | | 60 | 0 | 65.48 | 2.24 | 12.45 | 2.60 | B | A |
| | | | | 7 | 63.71 | 3.76 | 13.60 | | | |
| | 7-4 | | 90 | 0 | 63.79 | 3.44 | 13.06 | 1.73 | B | A |
| | | | | 7 | 62.11 | 3.86 | 13.19 | | | |
| | 7-5 | | 180 | 0 | 62.38 | 4.08 | 15.75 | 2.55 | B | A |
| | | | | 7 | 63.65 | 3.60 | 13.60 | | | |
| | 7-6 | 90 | 60 | 0 | 69.37 | 2.74 | 14.28 | 3.16 | B | B |
| | | | | 7 | 66.30 | 3.47 | 14.56 | | | |
| | 7-7 | | 90 | 0 | 63.76 | 2.97 | 11.83 | 1.70 | B | A |
| | | | | 7 | 62.22 | 3.56 | 12.23 | | | |
| | 7-8 | | 180 | 0 | 65.70 | 4.07 | 16.12 | 1.62 | B | A |
| | | | | 7 | 64.83 | 3.99 | 14.75 | | | |
| | 7-9 | 180 | 60 | 0 | 81.16 | 0.51 | 17.37 | 2.05 | A | A |
| | | | | 7 | 79.62 | 1.24 | 18.49 | | | |
| | 7-10 | | 180 | 0 | 76.79 | 2.30 | 18.23 | 1.29 | A | A |
| | | | | 7 | 75.77 | 2.62 | 18.95 | | | |

As summarized in Table 8, Examples 7-1 to 7-10 showed good results in the discharge printing ability evaluation and the discoloration prevention evaluation.

It will be obvious to those having skill in the art that many changes may be made in the above-described details of the particular aspects described herein without departing from the spirit or scope of the invention as defined in the appended claims.

What is claimed is:

1. A discharge printing device, comprising:

an application unit configured to apply a reducing agent to fabric; and a contact heating unit configured to subject a reducing agent-applied area to contact heating, wherein the discharge printing device satisfies any of the following conditions (a1), (b1), (c1), (d1), and (e1):

the condition (a1): in the contact heating, a heating temperature is 100° C. or more and less than 150° C., and a heating time is 60 seconds or more;

the condition (b1): in the contact heating, a heating temperature is 150° C. or more and less than 170° C., and a heating time is 45 seconds or more;

the condition (c1): in the contact heating, a heating temperature is 170° C. or more, and a heating time is 30 seconds or more;

the condition (d1): the contact heating unit subjects the reducing agent-applied area to contact heating to accelerate a reduction reaction and subjects, after the acceleration of the reduction reaction, the reducing agent-applied area to contact heating to accelerate an oxidation reaction; and the condition (e1): the contact heating unit subjects the reducing agent-applied area to the contact heating to accelerate a reduction reaction, and the discharge printing device further comprises a non-contact heating unit, and the non-contact heating unit subjects, after the acceleration of the reduction reaction, the reducing agent-applied area to non-contact heating to accelerate an oxidation reaction.

2. The discharge printing device according to claim 1, wherein the discharge printing device satisfies any of the conditions (a1), (b1), and (c1), and the heating time is 90 seconds or more.

3. The discharge printing device according to claim 1, wherein the discharge printing device satisfies any of the conditions (a1), (b1), and (c1), and the heating time is 180 seconds or more.

4. The discharge printing device according to claim 1, wherein the discharge printing device satisfies any of the conditions (a1), (b1), and (c1), and after the contact heating, the fabric is brought into contact with an atmosphere, and the reducing agent-applied area is then again heated.

5. The discharge printing device according to claim 1, wherein the discharge printing device satisfies any of the conditions (a1), (b1), and (c1) and further satisfies either of the following conditions (A) and (B):

the condition (A): after the contact heating, the contact heating unit again heats the reducing agent-applied area; and the condition (B): the discharge printing device further comprises a non-contact heating unit, and the non-contact heating unit subjects, after the contact heating, the reducing agent-applied area to non-contact heating.

6. The discharge printing device according to claim 1, wherein the discharge printing device satisfies either of the condition (d1) and (e1), and the fabric is brought into contact with an atmosphere between the acceleration of the reduction reaction and the acceleration of the oxidation reaction.

7. The discharge printing device according to claim 1, wherein the discharge printing device satisfies either of the condition (d1) and (e1), and a heating time in the acceleration of the oxidation reaction is 15 seconds or more.

8. The discharge printing device according to claim 1, wherein the discharge printing device satisfies the condition (d1), and the contact heating unit is a heat press machine.

9. The discharge printing device according to claim 1, wherein the reducing agent is a reducing agent-containing liquid, and the concentration of the reducing agent in the reducing agent-containing liquid is 0.28 mol/l or more.

10. The discharge printing device according to claim 1, wherein the discharge printing device satisfies any of the conditions (a1), (b1), and (c1), the discharge printing device further comprises an intervening member that can be arranged between the reducing agent-applied area and the contact heating unit, and a material for forming the intervening member is at least one selected from the group consisting of polytetrafluoroethylene-containing glass cloth, cellulose, and silicone resin-processed oil-resistant paper.

11. The discharge printing device according to claim 1, wherein the discharge printing device satisfies either of the condition (d1) and (e1), and a heating temperature and a heating time in the acceleration of the reduction reaction satisfy any of the following conditions (a2), (b2), and (c2):

the condition (a2): the heating temperature is 100° C. or more and less than 150° C., and the heating time is 60 seconds or more;

the condition (b2): the heating temperature is 150° C. or more and less than 170° C., and the heating time is 45 seconds or more; and the condition (c2): the heating temperature is 170° C. or more, and the heating time is 30 seconds or more.

12. A discharge printing method comprising:

an application step of applying a reducing agent to fabric; and a heat treatment step of subjecting a reducing agent-applied area to contact heating, wherein the discharge printing method satisfies any of the following conditions (a3), (b3), (c3), and (d3):

the condition (a3): in the heat treatment step, a heating temperature is 100° C. or more and less than 150° C., and a heating time is 60 seconds or more;

the condition (b3): in the heat treatment step, a heating temperature is 150° C. or more and less than 170° C., and a heating time is 45 seconds or more;

the condition (c3): in the heat treatment step, a heating temperature is 170° C. or more, and a heating time is 30 seconds or more; and the condition (d3): the heat treatment step comprises a reduction acceleration heat treatment step of subjecting a reducing agent-applied area to contact heating to accelerate a reduction reaction and an oxidation acceleration heat treatment step of heating, after the reduction acceleration heat treatment step, the reducing agent-applied area to accelerate an oxidation reaction, and the reducing agent-applied area is heated in the oxidation acceleration heat treatment step by contact heating or non-contact heating.

* * * * *